US008293080B2

(12) United States Patent
Barnard et al.

(10) Patent No.: US 8,293,080 B2
(45) Date of Patent: Oct. 23, 2012

(54) CONTACT RING HAVING ELECTRICALLY CONDUCTIVE BRUSH

(75) Inventors: Michael P. Barnard, Portland, ME (US); Hieyoung W. Oh, Bowdoin, ME (US); Jeffrey W. Richardson, Otisfield, ME (US)

(73) Assignee: Illinois Tool Works Inc., Glenview, IL (US)

( * ) Notice: Subject to any disclaimer, the term of this patent is extended or adjusted under 35 U.S.C. 154(b) by 9 days.

(21) Appl. No.: 12/816,621

(22) Filed: Jun. 16, 2010

(65) Prior Publication Data

US 2010/0252420 A1 Oct. 7, 2010

Related U.S. Application Data

(63) Continuation of application No. 11/445,556, filed on Jun. 2, 2006.

(51) Int. Cl.
*C25B 9/02* (2006.01)
*C25D 17/06* (2006.01)
*C25D 17/08* (2006.01)

(52) U.S. Cl. ..... 204/297.01; 204/224 R; 204/242; 204/279; 204/198; 204/202; 204/205; 204/206; 204/297.06; 204/297.1; 204/297.14

(58) Field of Classification Search ..... 204/198, 204/202, 204, 205, 206, 224 R, 279, 280, 204/288.3, 297.01, 297.06, 297.1, 297.14, 204/242
See application file for complete search history.

(56) References Cited

U.S. PATENT DOCUMENTS

| | | | | |
|---|---|---|---|---|
| 4,189,702 | A | 2/1980 | Maloy | |
| 4,358,699 | A | 11/1982 | Wilsdorf | |
| 5,865,979 | A | 2/1999 | Collins et al. | |
| 6,071,125 | A | 6/2000 | Shiozawa | |
| 6,071,400 | A * | 6/2000 | Schroder et al. | 205/686 |
| 6,277,336 | B1 | 8/2001 | Henrich et al. | |
| 7,136,271 | B2 * | 11/2006 | Oh et al. | 361/221 |
| 7,193,836 | B2 * | 3/2007 | Oh et al. | 361/220 |
| 2003/0052564 | A1 | 3/2003 | Wilsdorf | |

* cited by examiner

*Primary Examiner* — Bruce Bell
(74) *Attorney, Agent, or Firm* — Fletcher Yoder P.C.

(57) ABSTRACT

A conductive contact ring for an electroplating or electrodeposition process on a cylindrical surface includes a frame defining an opening through which the object can be passed and an array of electrically conductive fibers spanning the opening. The frame is electrically conductive and is connected to a DC power source in the process. Two or more contact rings can be used in a process to provide consistent electrical contact with the surface sliding therethrough. A single contact ring can have first and second groups of filaments spaced from each other along the axial length of the surface.

20 Claims, 2 Drawing Sheets

CONTACT RING HAVING ELECTRICALLY CONDUCTIVE BRUSH

CROSS-REFERENCE TO RELATED APPLICATION

This application is a continuation of U.S. patent application Ser. No. 11/445,556, filed Jun. 2, 2006, which is herein incorporated by reference in its entirety.

FIELD OF THE INVENTION

The present invention relates generally to electro-coating processes, such as electroplating and electrodeposition processes, and, more particularly, the invention pertains to such processes for tubing and even more particularly to the electrical contact formed with the tubing in an electrodeposition or electroplating process.

BACKGROUND OF THE INVENTION

Electroplating and electrodeposition have been used to provide surface layers on parts of many types, including tubing used in manufacturing coaxial cables to shield the conductor in the cable from ambient signals that would adversely affect the performance of the cable. In a known tubular coating process a continuous tube is pulled through a bath solution with conductive metal ions therein, such as, for example, silver, gold, copper, nickel and others. A cathode (negative pole) connection of a DC power supply is made with the endless tube. An anode of the metal used in the coating process is connected to the anode (positive pole) of the DC power supply. A metal coating is applied during the process.

In the coating process, a normally metallic coating is applied to the surface of an object by the action of electric current. The deposition of a metallic coating onto an object is achieved by creating a negative charge on the object to be coated and immersing it in a solution containing a salt of the metal to be deposited. The object to be coated is made the cathode of an electrolytic cell. Since the metallic ions of the salt carry a positive charge, the ions are attracted to the object. When the ions reach the negatively charged object that is to be coated, the object provides electrons to reduce the positively charged ions to metallic form. The result is a metal coated surface on the charged object. Such processes are used frequently for individual discrete parts. However, it is also known to use such processes for coating continuous lengths of tubing such as the aforementioned tubing used for manufacturing coaxial cable.

Creating a continuous electrical contact with a moving endless tube has presented difficulties. Known conductive methods to apply a charge to a continuous moving tube have included the use of copper or phosphorus brushes. A continuous conductive link is required between the brush and the moving tube for proper tubular coating as the electrical charge passes through the brush to the moving tube. A problem known in the tube coating industry is that known methods of brush to tube conductive contact tend to be somewhat intermittent. Intermittent electrical contact with the moving tube can cause inconsistent metal coating on the surface and possibly even extended areas of poor coating or voids that have no coating. Known brush contacts for electroplating continuous tubing wear relatively quickly and require frequent replacement. Further, copper brushes that have been used conduct charge to the tube differently as the brush wears, requiring constant monitoring of the charge or voltage, and adjustment as necessary.

There is a need for an efficient, reliable conductive contact system that can be used effectively in an electrocoating process for moving endless tubing, which contact system is of long life and requires minimal service or replacement.

SUMMARY OF THE INVENTION

The present invention provides an annular structure holding conductive fibers that encircle a tube passed through the structure. Continuous electrical contact is established between the conductive filaments and the tube passing therethrough.

In one aspect thereof, the present invention provides an electrical contactor for a cylindrical surface with a frame defining an opening therethrough of sufficient size for the cylindrical surface to be slid through the opening or slot. A first array of electrically conductive fibers partially spans the opening; and a second array of electrically conductive fibers partially spans the opening in generally opposed relation to the first array.

In another aspect thereof, the present invention provides a coating process assembly for coating an object having a cylindrical surface. The assembly has a bath for a coating solution, with the bath being adapted for the object to pass therethrough. An electrical contact ring has a frame defining an opening therethrough of sufficient size for the cylindrical surface to be slid through the opening. A first array of electrically conductive fibers partially span the opening, and a second array of electrically conductive fibers partially span the opening in generally opposed relation to the first array. An electrical power source is connected to contact ring.

In a still further aspect thereof, the present invention provides an electrical contactor for a cylindrical surface, with a frame of the contactor defining an opening therethrough of sufficient size for the cylindrical surface to be slid through the opening; and a plurality of electrically conductive fibers having ends thereof exposed in the opening. The fibers are flexible and pliable for deflection by an object sliding through the opening.

An advantage of the present invention is providing a contact ring useful for coating processes for plating continuous cylindrical objects moving through the contact ring.

Another advantage of the present invention is providing an electrical contact ring for an electro-coating process that is of long life useful and requires minimal service.

Still another advantage of the present invention is providing an annular contact ring for cylindrical objects or other similar shapes to be electro-coated that can be provided in different sizes for plating objects of different diameters.

Yet another advantage of the present invention is providing an electrical contact system for moving cylindrical objects that provides substantially consistent electrical contact around the circumference of the object.

Other features and advantages of the invention will become apparent to those skilled in the art upon review of the following detailed description, claims and drawings in which like numerals are used to designate like features.

Figure 1:
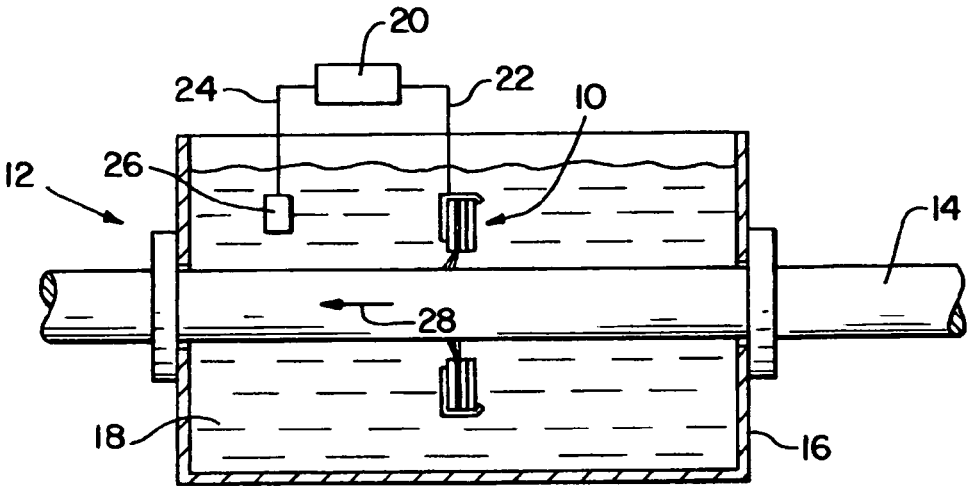
FIG. 1 illustrates an electroplating process using a contactor of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, an electrical conductive contact ring 10 in accordance with the present invention is shown in a process assembly 12 for providing a coating on an endless length of tube 14. Process assembly 12 includes a bath 16 having a plating solution 18 therein, which may be a solution of a metallic ion such as, for example, silver, gold, copper, nickel and others. A DC power source 20 is electrically connected via the cathode pole thereof through a cathode connection 22 to contact ring 10 and via the anode pole thereof through an anode connection 24 to a sacrificial anode 26 that replenishes the metal ions in solution 18 that are deposited on tube 14.

Contact ring 10 of the present invention can be used for known electroplating or electrodeposition processes to establish a continuous connection between the cathode pole of DC power source 20 and a moving cylindrical or rod-like member, such as continuous tube 14 that is pushed or drawn through contact ring 10, as indicated by arrow 28. The present invention can be used also to process a non-continuous body pushed or drawn therethrough. Contact ring 10 can be provided within bath 16, as shown in the exemplary embodiment. However, contact ring 10 also can be located before and/or after bath 16. If tube 14 is continuous, an electrical charge provided by contact ring 10 to tube 14 will run the length of tube 14. A process may include multiple baths to provide multiple layers of a desired coating, or a series of layers of different coatings. Those skilled in the art will understand the general nature of an electroplating or electrodeposition process, and therefore such processes will not be described more fully herein, except as relates to the use of contact ring 10.

In one embodiment of contact ring 10, an annular frame 30 can contain an array of conductive fibers or filaments 32. Frame 30 may define a circular opening 34 of sufficient diameter for tube 14 to pass therethrough. Frame 30 can be metal, conductive plastic or other electrically conductive material.

Figure 2:
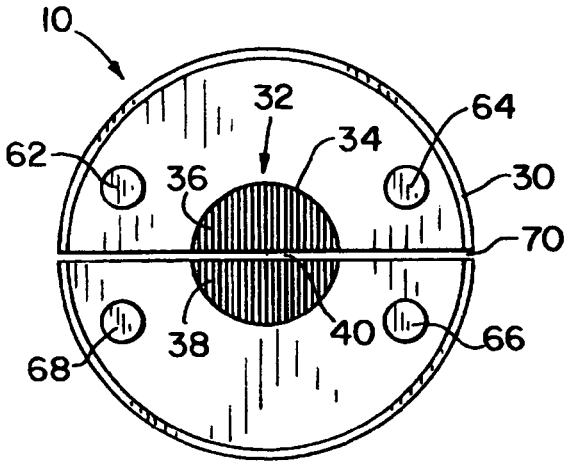
FIG. 2 is an elevational view of the contactor shown in FIG. 1.

In the embodiment shown in FIG. 2, conductive fibers or filaments 32 are provided in opposed first and second arrays or rows 36, 38 substantially filling opening 34. First and second rows 36, 38 of filaments or fibers 32 are separated one from the other at a separation line 40 spanning opening 34 substantially at a diameter of opening 34 so that fibers or filaments 32 can be deflected in rows 36 and 38 as tube 14 is passed through frame 30, as indicated by movement arrow 28 and demonstrated in FIG. 6. Rows 36 and 38 can be in substantial end to end engagement, with little or now space therebetween in the relaxed condition.

Figure 3:
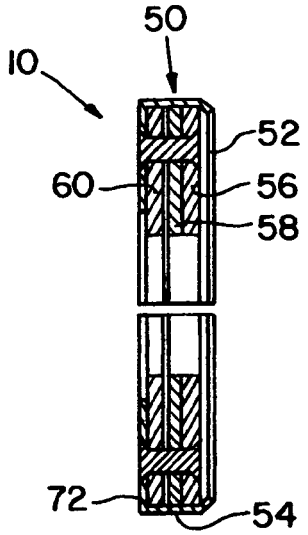
FIG. 3 is a cross-sectional view of the contactor shown in the previous drawings.

In the exemplary embodiment shown in FIG. 3, frame 30 includes a cup 50 having a bottom 52 and a sidewall 54. In the exemplary embodiment, a core including fiber retainers such as washers 56, 58 and 60 captures fibers or filaments 32 therebetween to hold the fibers in frame 30. Rivets 62, 64, 66, 68 are provided to secure washers 56, 58 and 60 in cup 50, extending from the outermost washer through bottom 52. Cup 50, washers 56, 58 and 60 and rivets 62, 64, 66 and 68 are conductive material, such as, for example, metal or conductive plastic. More or fewer washers and rivets can be used. Instead of washers, a conductive filler material of another type or form can be used to secure fibers 32 in frame 30. Frame 30 can be split at a center line 70 aligned with separation line 40 of fibers 32, or frame 30 can remain intact. In some instances of use, a split frame may facilitate changing contact ring 10 without removing tube 14 therefrom. If sidewall 54 extends above the stack of washers 56, 58 and 60, the outer edge of sidewall 54 can be rolled or pressed inwardly as indicated by numeral 72 to crimp washers 56, 58 and 60 against bottom 52.

Figure 5:
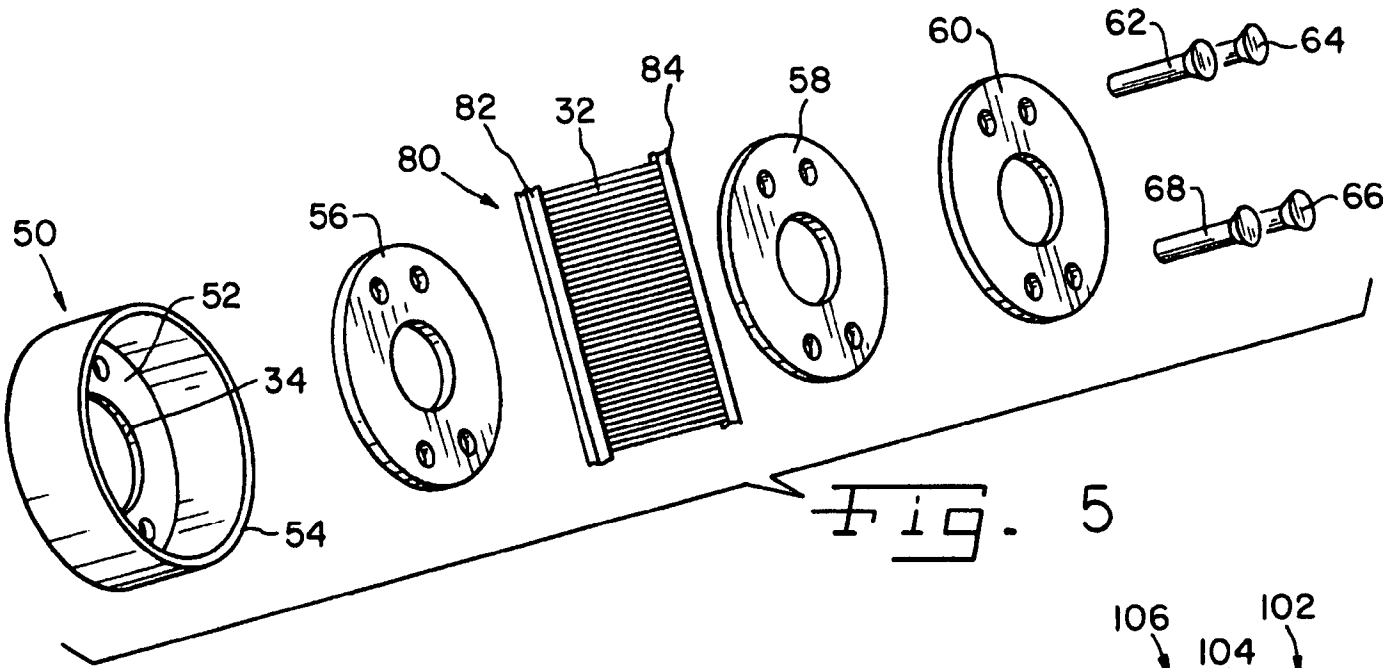
FIG. 5 is an exploded view of the electrical contact ring shown in FIGS. 1-3.

In the exemplary embodiment, filaments or fibers 32 are provided as a single fabric 80 (FIG. 5) bound at lateral edges 82, 84. Individual fibers as part of a continuous network extending between lateral edges 82, 84 are severed in the center to provide separation line 40 extending across opening 34. Each filament or fiber 32 is made from carbon or micro conductive fibers, conductive plastics such as acrylic or nylon fibers, or any other conductive fiber-type material. Highly durable materials that will not wear quickly provide long life of contact ring 10. During assembly, fabric 80 can be glued in place on one of the adjacent washers between which the fabric is sandwiched. Separation line 40 and a split, if used, in frame 30 at centerline 70 can be formed before or after assembly of fibers 32 in frame 30.

Figure 4:
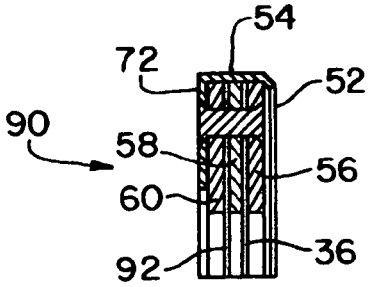
FIG. 4 is a fragmentary cross-sectional view similar to that of FIG. 3, but illustrating half of a further embodiment of the electrical contact ring.

FIG. 4 is a fragmentary view of one side of another embodiment for a contact ring 90 of the present invention in which a second piece of fabric is provided along with fabric 80 between washers 56, 58 and 60. With additional fiber arrays or rows 94, and another not shown in fabric 90, improved electrical contact between ring 10 and tube 14 is achieved.

Figure 6:
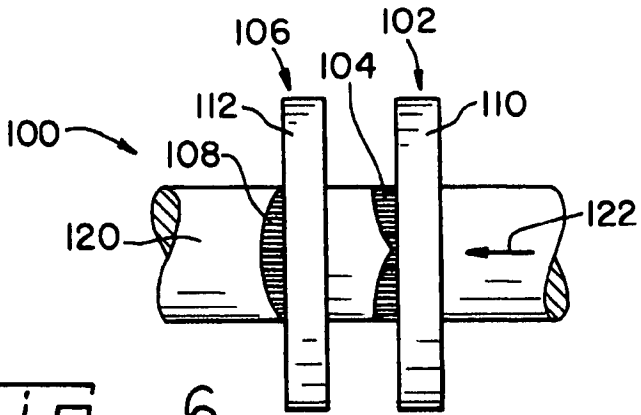
FIG. 6 is an illustration of another coating system.

FIG. 6 illustrates an assembly 100 for electroplating having a first contact ring 102 with fibers 104 and a second contact ring 106 with fibers 108. Fibers 104 and 108 are each severed on a diameter of openings in frames 110, 112 of contact rings 102, 106, respectively. A tube 120 is illustrated moving in a direction indicated by arrow 122. As tube 120 slides axially through frames 110, 112 fibers 104, 108 slide along the surface of tube 120 and are bent in the direction of movement. A bath (not shown) and a source (not shown) of DC current for assembly 100 are similar to those shown in FIG. 1.

In assembly 100, fibers 102, 104 are substantially perpendicular to the separation lines thereof. Accordingly, fibers in the center of the openings in frames 110 and 112 have longer exposed lengths than the fibers near the ends of the separation lines. As a result, with respect to axial lengths of the surface of tube 120, the fibers near the center provide a larger area of contact than the fibers near the ends. In assembly 100, contact rings 102, 104 are offset by 90° or so relative to each other, with respect to the orientations of the separation lines of fibers 104, 108. Accordingly, the patterns of contact for filaments 104, 108 against tube 120 are complementary, with filaments 108 providing increased contact along axial lengths of tube 120 in which filaments 104 provide less contact. Similarly, filaments 104 provide increased contact along axial lengths of tube 120 where filaments 108 provide less contact. As a result, electrical contact over the surface of tube 120 from an electrical connection is consistent and even throughout the surface of tube 120.

Embodiments of the present invention having more than one set of fibers, such as contact ring 90 and assembly 100 can be used when the process in being practiced requires a significant surface charge on the item. A single contact ring can be provided with more than two fabrics therein, and an assembly can use more than two contact rings.

Contact rings of the present invention provide a substantially continuous charge over the surface of a cylindrical surface passing therethrough in that the fibers of the contact rings are provided substantially continuously about the circumference of the cylindrical surface. Electro-coating process using contact rings of the present invention thereby are improved.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A system for electroplating or electrodeposition, comprising:
   - an electrical contact ring comprising:
     - a first plurality of electrically conductive fibers;
     - a first frame portion comprising a first annular interior disposed about a first opening; and
     - a second frame portion comprising a second annular interior disposed about a second opening, wherein the first and second openings are axially aligned with one another to define a first central space, the first plurality of electrically conductive fibers is held in place between the first and second frame portions, and the first plurality of electrically conductive fibers protrudes inwardly beyond a first innermost surface of at least one of the first or second annular interiors into the first central space; and
   - an electrical power source electrically coupled to the electrical contact ring, and configured to transfer an electrical charge to the electrical contact ring.

2. The system of claim 1, wherein the electrically conductive fibers are non-metallic.

3. The system of claim 1, wherein the electrically conductive fibers are microfibers.

4. The system of claim 1, wherein the first frame portion comprises a cup, and the second frame portion comprises a disc positioned in the cup.

5. The system of claim 4, wherein the electrical contact ring comprises a plurality of fasteners each extending axially into both the cup and the disc.

6. The system of claim 1, wherein the first plurality of electrically conductive fibers protrudes inwardly beyond the first innermost surface to a first plurality of distances that are different from one another.

7. The system of claim 6, wherein the first plurality of electrically conductive fibers comprise central fibers surrounded by peripheral fibers, and the central fibers protrude inwardly beyond the first innermost surface to greater distances than the peripheral fibers.

8. The system of claim 1, wherein the electrical contact ring comprises a second plurality of electrically conductive fibers offset from the first plurality of electrically conductive fibers, wherein the second plurality of electrically conductive fibers protrudes inwardly beyond the first innermost surface of at least one of the first or second annular interiors.

9. The system of claim 8, wherein the first plurality of electrically conductive fibers protrudes inwardly beyond the first innermost surface to a first plurality of distances that are different from one another, and the second plurality of electrically conductive fibers protrudes inwardly beyond the first innermost surface to a second plurality of distances that are different from one another.

10. The system of claim 1, wherein the electrical contact ring comprises:
   - a second plurality of electrically conductive fibers;
   - a third frame portion comprising a third annular interior disposed about a third opening;
   - a fourth frame portion comprising a fourth annular interior disposed about a fourth opening, wherein the third and fourth openings are axially aligned with one another to define a second central space, the second plurality of electrically conductive fibers is held in place between the third and fourth frame portions, the second plurality of electrically conductive fibers protrudes inwardly beyond a second innermost surface of at least one of the third and fourth annular interiors.

11. The system of claim 10, wherein third and fourth frame portions are axially offset from the first and second frame portions along an axis through the first, second, third, and fourth openings, wherein the second plurality of electrically conductive fibers is angularly offset from the first plurality of electrically conductive fibers relative to the axis through the first, second, third, and fourth openings.

12. A system for electroplating or electrodeposition, comprising:
   - an electrical contact ring comprising:
     - a first plurality of electrically conductive fibers made of a non-metallic material; and
     - a frame comprising a shaft opening with an inner diameter defined by an innermost circumference of the frame, wherein the first plurality of electrically conductive fibers protrudes inwardly from the innermost circumference into the shaft opening, and the first plurality of electrically conductive fibers is configured to conduct a charge between the frame and a shaft passing through the shaft opening; and
   - an electrical power source electrically coupled to the electrical contact ring, and configured to transfer an electrical charge to the electrical contact ring.

13. The system of claim 12, wherein the electrically conductive fibers are made of a conductive plastic.

14. The system of claim 12, wherein the electrically conductive fibers are microfibers.

15. The system of claim 12, wherein the frame comprises a first frame portion and a second frame portion, and the first plurality of electrically conductive fibers is axially compressed between the first and second frame portions.

16. The system of claim 15, wherein the first frame portion comprises a cup, and the second frame portion comprises a disc positioned in the cup.

17. The system of claim 12, wherein the first plurality of electrically conductive fibers protrudes inwardly from the innermost circumference to a first plurality of distances that are different from one another.

18. The system of claim 17, wherein the electrical contact ring comprises a second plurality of electrically conductive fibers offset from the first plurality of electrically conductive fibers, wherein the second plurality of electrically conductive fibers protrudes inwardly from the innermost circumference to a second plurality of distances that are different from one another.

19. A system for electroplating or electrodeposition, comprising:

an electrical contact ring comprising:

a first plurality of electrically conductive fibers;

a second plurality of electrically conductive fibers offset from the first plurality of electrically conductive fibers;

a cup frame portion comprising a first annular interior disposed about a first opening; and a disc frame portion comprising a second annular interior disposed about a second opening, wherein the disc frame portion is positioned in the cup frame portion, the first and second plurality of electrically conductive fibers is sandwiched between the cup frame portion and the disc frame portion, the first and second plurality of electrically conductive fibers have distal ends inwardly offset from an innermost circumference of the first and second annular interiors; and an electrical power source electrically coupled to the electrical contact ring, and configured to transfer an electrical charge to the electrical contact ring.

20. The system of claim 19, wherein the first and second plurality of electrically conductive fibers are made of a non-metallic material, the distal ends are disposed at a plurality of different distances from the innermost circumference, and the first and second plurality of electrically conductive fibers are free to bend between the innermost circumference and the distal ends.

* * * * *